US009726442B2

(12) United States Patent
Bagwell et al.

(10) Patent No.: US 9,726,442 B2
(45) Date of Patent: Aug. 8, 2017

(54) CHILLED BEAM DEVICES, SYSTEMS, AND METHODS

(75) Inventors: Rick A. Bagwell, Scottsville, KY (US); Janne Summanen, Jarvenpaa (FI); Andrey V. Livchak, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 1219 days.

(21) Appl. No.: 13/574,645

(22) PCT Filed: Jan. 24, 2011

(86) PCT No.: PCT/US2011/022287

§ 371 (c)(1),
(2), (4) Date: Jul. 23, 2012

(87) PCT Pub. No.: WO2011/091380

PCT Pub. Date: Jul. 28, 2011

(65) Prior Publication Data

US 2012/0295532 A1 Nov. 22, 2012

Related U.S. Application Data

(60) Provisional application No. 61/297,800, filed on Jan. 24, 2010.

(51) Int. Cl.
*F28D 15/00* (2006.01)
*F28F 27/02* (2006.01)
(Continued)

(52) U.S. Cl.
CPC ..... *F28F 27/02* (2013.01); *F24F 1/01* (2013.01); *F24F 5/0092* (2013.01); *F24F 13/26* (2013.01);
(Continued)

(58) Field of Classification Search
CPC .. F24F 1/01; F24F 13/26; F24F 5/0092; F24F 2221/14; F24F 2001/0062; F24F 2013/0612; F28F 27/02
(Continued)

(56) References Cited

U.S. PATENT DOCUMENTS 3,032,323 A 5/1962 Church
3,122,201 A 2/1964 Ashley et al.
(Continued)

FOREIGN PATENT DOCUMENTS

AU 2010201383 10/2010
CA 2 685 977 6/2010
(Continued)

OTHER PUBLICATIONS

Communication pursuant to Article 94(3), issued Feb. 27, 2015, in European Patent Application No. 11735324.3.
(Continued)

*Primary Examiner* — Gregory Huson
*Assistant Examiner* — Dana Tighe
(74) *Attorney, Agent, or Firm* — Potomac Law Group, PLLC; Mark Catan

(57) ABSTRACT

A chilled beam system may incorporate a terminal unit to provide additional heating and cooling capacity including latent cooling. In a system, terminal units may be distributed and connected to cooperate with a primary air stream from a central air handling unit. The chilled beam and/or terminal units may employ features for enhancing heating mode operation. Control embodiments take advantage of the additional capabilities described.

12 Claims, 9 Drawing Sheets

(51) Int. Cl.

| | |
|---|---|
| ***F24F 13/26*** | (2006.01) |
| ***F24F 1/01*** | (2011.01) |
| ***F24F 5/00*** | (2006.01) |
| *F24F 1/00* | (2011.01) |

(52) U.S. Cl.
CPC ... *F24F 2001/0062* (2013.01); *F24F 2221/14* (2013.01)

(58) Field of Classification Search
USPC ..... 454/237, 284, 322, 370; 62/176.6
See application file for complete search history.

(56) References Cited

U.S. PATENT DOCUMENTS

| | | | | |
|---|---|---|---|---|
| 3,172,463 | A | 3/1965 | Urban | |
| 3,217,788 | A | 11/1965 | Adam | |
| 3,424,233 | A | 1/1969 | Meckler | |
| 3,720,258 | A | 3/1973 | Chandler | |
| 3,823,870 | A | 7/1974 | Chandler | |
| 4,181,253 | A | 1/1980 | Barlow | |
| 4,473,107 | A | 9/1984 | Fairbrother et al. | |
| 5,953,926 | A | 9/1999 | Dressler | |
| 6,079,626 | A | 6/2000 | Hartman | |
| 6,213,867 | B1 * | 4/2001 | Yazici | F24F 1/01 454/261 |
| 6,427,454 | B1 | 8/2002 | West | |
| 6,569,010 | B1 * | 5/2003 | Miller | F24F 1/01 454/233 |
| 6,623,353 | B1 * | 9/2003 | Akhtar | F24F 1/01 454/233 |
| 6,769,477 | B2 * | 8/2004 | Hakkinen | F24F 1/0059 165/123 |
| 7,000,688 | B2 * | 2/2006 | Horttanainen | F24F 11/027 165/123 |
| 8,327,836 | B2 | 12/2012 | Brown et al. | |
| 8,469,783 | B2 | 6/2013 | Juslin et al. | |
| 2003/0042012 | A1 | 3/2003 | Pearson | |
| 2005/0056042 | A1 | 3/2005 | Bourne et al. | |
| 2008/0112128 | A1 | 5/2008 | Holland | |
| 2009/0264062 | A1 * | 10/2009 | Miller | F24F 1/0059 454/237 |
| 2010/0140363 | A1 | 6/2010 | Hirsch et al. | |
| 2011/0155354 | A1 | 6/2011 | Karamanos et al. | |
| 2012/0245739 | A1 | 9/2012 | Grabon et al. | |

FOREIGN PATENT DOCUMENTS

| | | | |
|---|---|---|---|
| CN | 101057205 | A | 10/2007 |
| CN | 101576299 | A | 11/2009 |
| CN | 101576304 | A | 11/2009 |
| EP | 0 023 757 | A1 | 2/1981 |
| EP | 2116780 | | 11/2009 |
| EP | 2244021 | | 10/2010 |
| JP | 02-103324 | | 4/1990 |
| WO | 03/102484 | | 12/2003 |
| WO | WO 2007/063355 | A1 | 6/2007 |
| WO | WO 2008/119893 | A1 | 10/2008 |
| WO | 2009089618 | | 7/2009 |
| WO | WO 2010/061205 | A1 | 6/2010 |

OTHER PUBLICATIONS

Office Action, issued Feb. 11, 2015, in Russian Patent Application No. 2012135066/12(056192) with English translation.

Office Action, issued Mar. 27, 2014, in Chinese Patent Application No. 201180007024.4.

Russian Office Action for RU2012135066/12 dated Jun. 15, 2015 with English translation.

Communication pursuant to Article 94(3), issued Jun. 11, 2014, in European Patent Application No. 11735324.3.

Australian Office action for AU2011207455 dated Jun. 25, 2014.

Supplementary European Search Report and Search Opinion, issued Aug. 18, 2013, in European Patent Application No. 11 73 5324.3.

Second Chinese Office Action for CN Application No. 201180007024.4 issued on Sep. 24, 2014 with an English translation.

Office Action, issued Mar. 31, 2015, in Japanese Patent Application No. JP2012-550200 with English translation.

Third Chinese Office Action for CN Application No. 201180007024.4 issued Jan. 12, 2015 (English Translated).

Office Action issued Jul. 25, 2016 in Mexican Patent Application No. MX/a/2012/008519 with English translation.

Office Action for Canadian Patent Application No. 2787151 dated Dec. 19, 2016.

Office Action for Mexican Patent Application No. MX/a/2012/008519 issued on Oct. 14, 2016 (includes English language translation).

Office Action for U.S. Appl. No. 14/266,806 issued on Jan. 12, 2017.

"Warming Up . . . to Chilled Beam Technology", Office Insights, Hixson Architecture Engineering Interiors, Spring 2009 (actual publication date not available).

Non-Final Office Action for U.S. Appl. No. 14/266,806, dated Jun. 12, 2017.

Office Action for Australian Patent Application No. 2016201936, dated Apr. 28, 2017.

* cited by examiner

CHILLED BEAM DEVICES, SYSTEMS, AND METHODS

CROSS REFERENCE TO RELATED APPLICATIONS

The present application is a U.S. national stage of International Application No. PCT/US11/22287, filed Jan. 24, 2011, which claims the benefit of U.S. Provisional Application No. 61/297,800, filed Jan. 24, 2010, both of which are incorporated by reference herein in their entireties.

BACKGROUND

A chilled beam, more particularly, an active chilled beam, is a combined discharge register and heat exchanger that is provided in the ceiling of a conditioned space. The discharge register portion receives primary air that is conditioned to satisfy the latent load of the conditioned space, the ventilation requirements of the conditioned space, and some of the sensible load of the conditioned space. The sensible load is further satisfied in an active chilled beam by cooling primary and some secondary conditioned space air using the heat exchanger portion. The primary air is ejected through nozzles to create the secondary flow by induction thereof. Water is pumped through the heat exchanger portion at a temperature that is above the dew point to prevent the heat exchanger portion causing condensation.

Active chilled beams provide benefits in areas with substantial sensible cooling and heating requirements and relatively mild ventilation requirements. This is because they can save on the primary air requirements associated with traditional VAV systems. Active chilled beams also are associated with low noise levels.

In addition, due to the very low noise levels of active chilled beams buildings that have special noise levels requirements are good candidates. Finally zones where there is high concern about indoor environment quality are ideal candidates as the conditioned spaces are provided with proper ventilation air and humidity control at all times and under all load conditions.

Generally, active chilled beams in a zone are supplied by a respective air handling unit. The air handling units can provide temperature-neutral latent load reduction by, for example, a desiccant wheel. The water temperature can be controlled by a control valve regulating flow through the heat exchanger portion from a water supply to a return. Water temperature can also be controlled by varying the rate of flow on either side of a heat exchanger that removes heat from the water.

SUMMARY

The Summary describes and identifies features of some embodiments. It is presented as a convenient summary of some embodiments, but not all. Further the Summary does not identify critical or essential features of the embodiments, inventions, or claims.

According to an embodiment of the disclosed subject matter, a method of satisfying the load of a conditioned space includes conveying primary air from a central air handling unit to the primary air inlet of a chilled beam. The method further includes conveying conditioned return air to the primary air inlet of the chilled beam. In a variation, the conveying conditioned return air includes cooling return air from the conditioned space and mixing the result with the primary air from the central air handling unit to produce a combined primary air stream, which is provided to the primary air inlet of the chilled beam. In another variation, the conveying conditioned return air includes cooling return air from the conditioned space and mixing the result in a terminal unit with the primary air from the central air handling unit to produce a combined primary air stream, which is provided to the primary air inlet of the chilled beam. In yet another variation, the conveying primary air from a central air handling unit includes conveying primary air at a quality and rate that is sufficient to satisfy a ventilation load of the conditioned space but insufficient to supply a design thermal load requirement.

According to further embodiments, the disclosed subject matter includes a chilled beam system for a conditioned space. The system includes a handling unit configured to convey primary air from a central air handling unit to the primary air inlet of a chilled beam. The terminal unit configured to convey conditioned return air to the primary air inlet of the chilled beam. The conditioned return air may be cooled by the terminal unit and the result is mixed the terminal unit with the primary air from the central air handling unit to produce a combined primary air stream, which the terminal unit provides to the primary air inlet of the chilled beam. The terminal unit may be configured to mix the result in the terminal unit with the primary air from the central air handling unit to produce a combined primary air stream, and provide it to the primary air inlet of the chilled beam. The primary air from the central air handling unit may include a mechanism for conveying primary air at a quality and rate that is sufficient to satisfy a ventilation load of the conditioned space but insufficient to supply a design thermal load requirement. The terminal unit may include a condensing cooling coil configured to reduce the moisture content of the return air. The terminal unit includes a desiccant component configured to reduce the moisture content of the return air.

According to embodiments, the disclosed subject matter includes a method of satisfying the load of a conditioned space. The method includes creating a flow of primary air from a central air handling unit. The air handling unit provides fresh air from outside a building plus recirculated air in selectable ratios for form the primary air that is conveyed. The method further includes conveying the primary air from the central air handling unit to the inlet of chilled beams and creating a flow of conditioned recirculated air from terminal units. Each of the terminal units is connected to receive return air from a conditioned space served by a subset of the chilled beams and change an enthalpy of the return air to create the conditioned recirculated air. The primary air is received by the chilled beams after being combined with recirculated air flow created by the terminal units, the primary and recirculated air being combined within the terminal unit or by mixing output flows of the terminal units and the central air handling unit.

The conveying conditioned return air may include cooling return air from the conditioned space within the terminal unit and mixing the result with the primary air from the central air handling unit to produce a combined primary air stream, which is provided to the primary air inlet of the chilled beam. The changing of the enthalpy in the terminal units may include removing moisture from the return air.

According to embodiments, the disclosed subject matter includes a method of satisfying the load of a conditioned space. The method includes providing a terminal unit with a heat exchanger. The terminal unit is connected to a conditioned space to receive return air therefrom. The terminal unit is configured to condition the return air using the heat exchanger and combine conditioned return air with a primary air stream, which includes fresh air. The method further includes generating a heating mode signal and configuring one of the terminal unit and a chilled beam in response to the heating mode signal. The configuring includes changing an aspect ratio of a discharge into the occupied space or switching the flow into the occupied space from a first aspect ratio discharge to a second aspect ratio discharge, wherein the first and second aspect ratios differ in magnitude.

The method may include configuring the one of the terminal unit and a chilled beam in response to a cooling mode signal, the configuring including changing an aspect ratio of a discharge into the occupied space or switching the flow into the occupied space from the second aspect ratio discharge to the first aspect ratio discharge, wherein the first and second aspect ratios differ in magnitude.

According to embodiments, the disclosed subject matter includes apparatus for conditioning the air of an occupied space. The apparatus includes a terminal unit with a heat exchanger. The terminal unit is connected to a conditioned space to receive return air therefrom. The terminal unit is configured to condition the return air using the heat exchanger and combine conditioned return air with a primary air stream, which includes fresh air. The apparatus further includes a chilled beam and a controller configured to generate a heating mode signal. The controller is connected to control at least one actuator adapted to reconfigure one of the terminal unit, a chilled beam, or a further device in response to the heating mode signal. The reconfiguring includes changing an aspect ratio of a discharge into the occupied space or switching the flow into the occupied space from a first aspect ratio discharge to a second aspect ratio discharge, wherein the first and second aspect ratios differ in magnitude.

The terminal unit may include a damper configured to vary a mix of return air from the occupied space and air from the primary air stream. The terminal unit may include a powered air mover such as a fan or blower. Each terminal unit may be connected to multiple chilled beams and multiple terminal units may be connected to an air handler providing primary air.

DESCRIPTION

The description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention. In particular, exemplary embodiments are provided below that specifically describe camera-ready or printed documents. Such specifics are for illustrative purposes only and one of ordinary skill will recognize that documents of various, different formats may be used without departing from the scope of the present invention.

Figure 1:
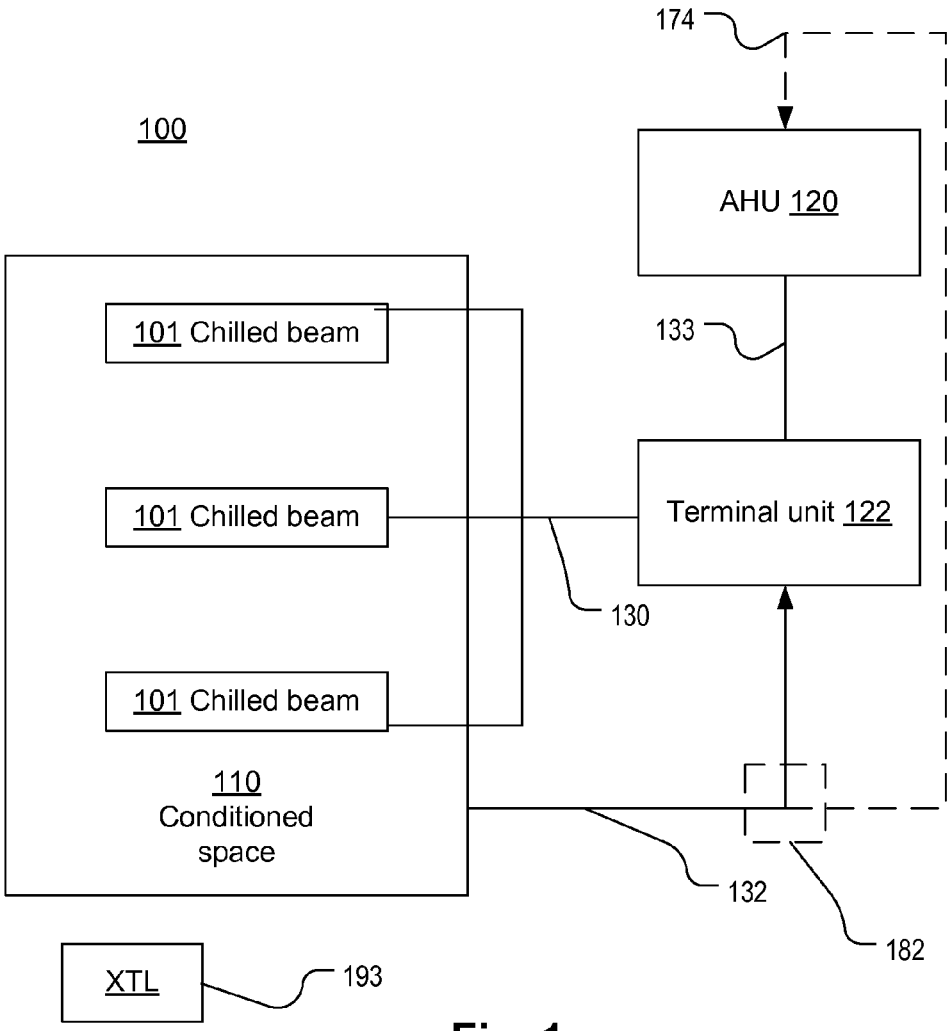
FIG. 1 shows a chilled beam system according to an embodiment of the disclosed subject matter.

Referring to FIG. 1, a chilled beam system 100 provides heating and cooling to one or more conditioned spaces 110. The latter may be rooms in a building, meeting halls, warehouses, classrooms, data centers, or any of a variety of different occupied spaces requiring heating and/or cooling. Each space is provided with one or more chilled beams 101 which may be any suitable terminal unit with a heat exchanger heated or cooled by a flow of water or other heat transfer fluid and a source or ventilation air. Such terminal units are identified herewithin as active chilled beams.

Each chilled beam 101 receives final primary air 130 from a terminal unit 122 which conditions a return air stream 132 extracted from the conditioned space(s) 110. The return air stream may be provided from one or more return air registers serving (each of) the conditioned space(s) 110. The return air stream may also be provided from a selectable subset of multiple return air registers, one or more located near the ceiling for the cooling mode and one or more located low near the floor for heating mode. In embodiments, the heating or cooling return air registers may be selected based on whether heating or cooling is being supplied to the conditioned space employing any suitable control interconnect. The selection may be provided by a mode-switched damper, for example.

The terminal unit 122 conditions the return air 132 from the conditioned space and mixes the conditioned return air with initial primary air 133 from an air handling unit 120. The mixture forms the flow of final primary air 130. A fraction 174 (between 0 and 100 percent) of the return air may also be conveyed back to the air handling unit 120. A variable mixing box 182 may be provided to control the fraction of air returned to the terminal unit 122 and the air handling unit 120. The latter feature of a mixing box and return air channel to the air handling unit may be provided in any of the embodiments disclosed. A controller 193 may be provided to control the system and components as described below for any of the embodiments. The controller may generate heating mode signals, cooling mode signals in a conventional fashion. Also, or alternatively, the controller may generate commands or signals to cause the terminal units and/or chilled beams of the embodiments to configure for a cooling mode or a heating mode. The controller 193 may be connected to control one or more actuators 149 for configuring chilled beams and/or terminal unit dampers as described elsewhere in the present disclosure.

Figure 2:
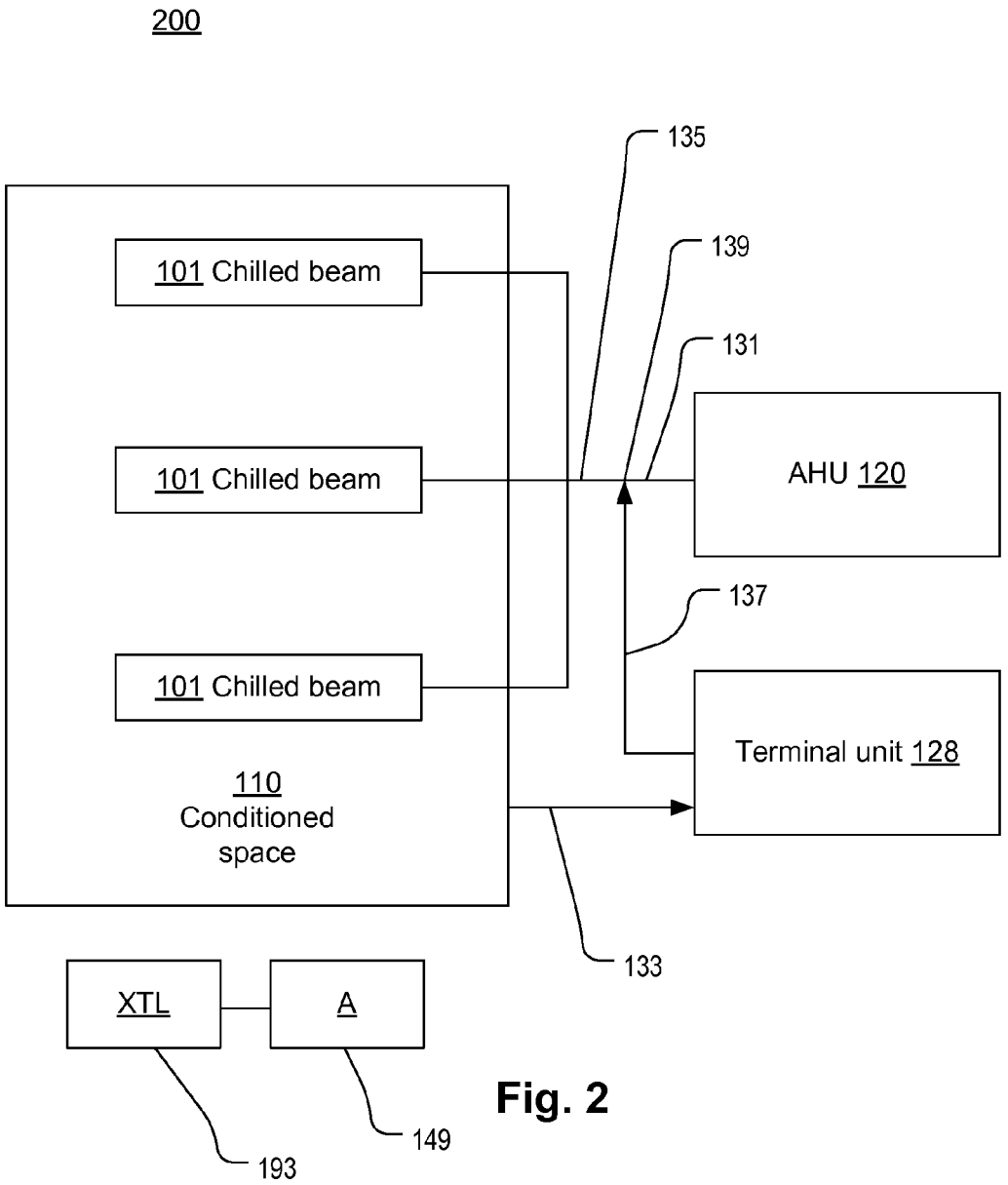
FIG. 2 shows a chilled beam system according another embodiment of the disclosed subject matter.

Referring to FIG. 2, a chilled beam system 200 provides heating and cooling to one or more conditioned spaces 110. As in the prior embodiment, the latter may be rooms in a building, meeting halls, warehouses, classrooms, data centers, or any of a variety of different occupied spaces requiring heating and/or cooling. Each space is provided with one or more chilled beams 101 as in the embodiment 100. Each chilled beam 101 receives final primary air 135 from a terminal unit 128 and an air handling unit 120 whose outputs are mixed at a mixing junction 139. The terminal unit 128 conditions a return air stream 133 from the conditioned space and supplies the conditioned air 137 in parallel with the primary air 131 from the air handling unit 120 via the mixing junction 139. As in the prior embodiments, the return air stream 133 may be provided from one or more return air registers serving the conditioned space 110. The return air stream 133 may also be provided by a selectable subset of multiple return air registers, some located near the ceiling for the cooling mode and one located low near the floor for heating mode. As stated above, the ceiling registers may be automatically selected during cooling and the floor registers selected during heating. The latter control, as in all embodiments, may be slaved to a mode switch.

Figure 3:
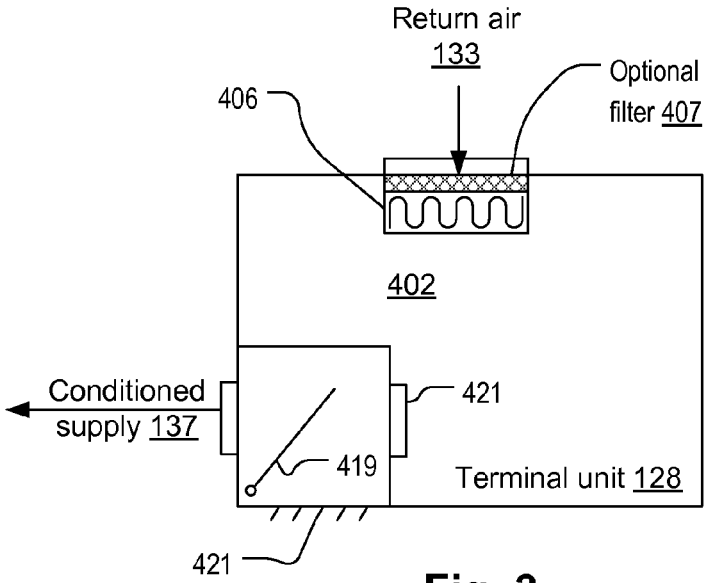
FIG. 3 shows a terminal unit for use in the embodiment of FIG. 1.

Referring to FIG. 3, the terminal unit 128 has a flow chamber 402 with a heat exchanger 406 which provides heating or cooling to condition the return air stream 133 from the conditioned space as described with reference to FIG. 2. A filter 407 may be provided in this and any of the other embodiments. The heat exchanger may be a water cooled liquid/air heat exchanger, an electric air heater, a gas-fired furnace, or any suitable source of heat or cool. Alternatively, the heat exchanger 406 may be a multimode device with one or more heat exchangers or a single switchable heat exchanger that can supply heat and cooling effect or plurality of devices providing, at any given time, a selected one of heating and cooling functions (or both to respective air streams). The conditioned air leaves the terminal unit 128 as a conditioned supply 131. The change in function can be provided, for example, by mode-switched valves connecting a single heat exchanger selectively to one of a chiller and a heater.

In the present embodiment of FIG. 3 or the embodiment of FIG. 4 to be described below, a damper may regulate the proportion of flow to be provided to a direct mixing register 421 (which may be directly connected to the terminal unit or separately by a duct) or the conditioned supply 137 connected to one or more chilled beams. The purpose of providing a different outlet from the chilled beams is that chilled beams are generally designed to provide relatively low primary air volume and once mixed with the induced return flow that passes through the heat exchanger, the mixed air ejected by the beam is of relatively low velocity. If heated air is supplied at low velocity from the ceiling level where the chilled beams are located, there is a tendency for the warm air to remain at a high level and thereby be less effective at providing comfort. By ejecting a flow of air at high velocity and low aspect ratio from a suitable mixing register, the throw of the heated jet can be greater and the comfort effect of the heated stream greater. The damper 419 may be switched in response to mode (heating versus cooling). It may also provide a variable ratio of air between the mixing outlet and the beam outlet. A fan, as discussed with reference to the embodiments of FIG. 4 may also be provided to provide a greater volume rate of flow.

With a higher volume rate including return air directly provided to the terminal unit as well as primary air from the air handling unit, the design beam volume rate may be met whilst still providing additional volume for effective use of the mixing register 421. In an alternative embodiment, a simple damper is used in the mixing register output and at least some air is always permitted to go to the beam output 137. The fan may be a variable rate fan and may be turned off under selected conditions, for example, proportionally in response to higher load, during heating (when the mixing register is used in combination with the beams). Note in some embodiments, the beams may be bypassed in heating mode and a mixing register used alone.

Figure 4:
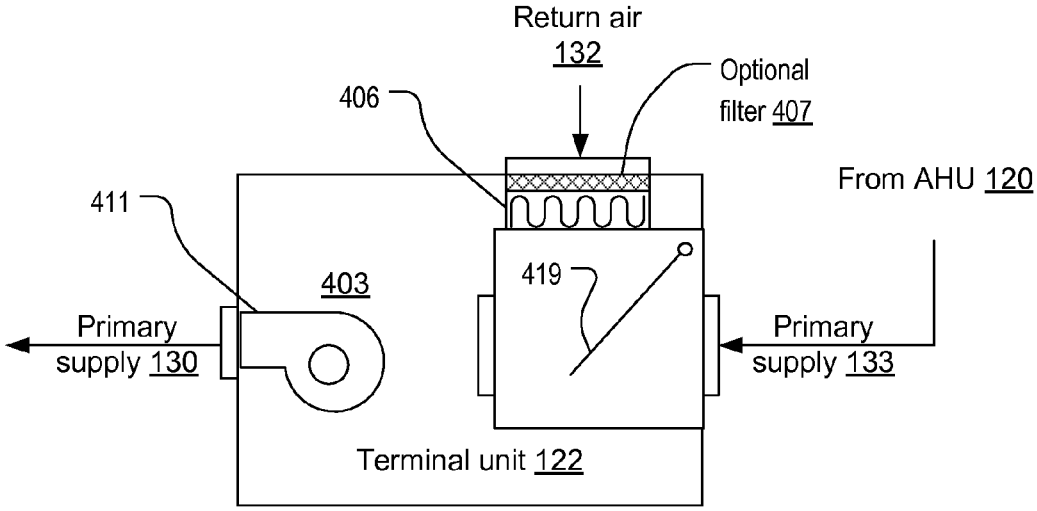
FIG. 4 shows a terminal unit for use in the embodiment of FIG. 2.

Referring to FIG. 4 the terminal unit 122 has a flow chamber with a heat exchanger 406 which provides heating or cooling to condition the return air stream 132 from the conditioned space as described with reference to FIG. 1. The heat exchanger may be a water cooled liquid/air heat exchanger, an electric air heater, a gas-fired furnace, or any suitable source of heat or cool. Alternatively, the heat exchanger 406 may be a multimode device that can supply heat and cooling effect or plurality of devices providing, at any given time, a selected one of heating and cooling functions. The conditioned return air is mixed with the primary supply air 133 from the air handling unit 120 in a mixing flow chamber 403, which it leaves as the final primary air 130. In any of the embodiments described herein, a fan or other air mover 411 may be provided to provide increased volume flow, capability for balancing flow among local groups of chilled beams, or to overcome additional resistance of the heat exchanger 405, filter 407, or other factors. In addition or alternatively, a damper 417 may be provided in any of the embodiments to allow the variation of the mix of return 132 and supply 133 air in the primary supply 130.

In any of the embodiments, a damper 419 may provide for selection of the ratio of primary supply 133 from the air handling unit 120 and the return air 132 from the conditioned space. A fan 411 may be provided as discussed above and shown here. In low profile embodiments of terminal units, for example as discussed later for use with configurations that can fit over a hung ceiling, suitable fan designs such as tangential fans may be employed.

In embodiments of any of the systems described herein, return air passes through a mixing valve configured to exhaust a selectable amount of the return air and replace that amount with fresh air from a fresh air source. The resulting partial stream may be fed to the supply terminal unit.

In embodiments, the terminal unit 128 is configured to permit primary supply air to be tempered by a heat exchanger in addition to the tempering of the return air stream.

In embodiments of the systems described herein, return air passes through a mixing valve configured to exhaust a selectable amount of the return air. The resulting diminished stream is fed to the supply terminal unit. In a further embodiment, the terminal unit has mixes a selectable quantity of fresh air with the conditioned return air.

In any of the embodiments described, various control methods will be recognized as suitable for regulating the rate of heating or cooling required.

In any of the embodiments described, the terminal unit may include a regenerating desiccant to handle at least part of the latent load of the space.

In embodiments of the systems described herein, a terminal unit is retrofitted to an existing chilled beam system which is otherwise configured to provide only cooling. In such a retrofit, the terminal unit adds heating capability to the system.

In any of the embodiments described, a terminal unit is provided as a retrofit to provide an increased heating and/or cooling capacity to an existing chilled beam system.

In a method of providing a chilled beam system, a cooling load is satisfied by designing providing a capacity of a chilled beam air handling unit is based on ventilation requirements which may be ineffective for handling the total cooling load. In the method, the supplemental cooling effect is provided by a terminal unit as in any of the embodiments. In such system, the capacity of the terminal unit is sufficient to satisfy the total cooling load, reduced by the cooling effect provided by the air handling unit. In embodiments, systems are configured with components of the specified relative capacities.

In one or more system embodiments of a chilled beam system, a cooling load is satisfied by designing providing a capacity of a chilled beam air handling unit is based on ventilation requirements which may be ineffective for handling the total cooling load. In the systems, the supplemental cooling effect is provided by a terminal unit as in any of the embodiments.

In control embodiments, the heat exchanger and/or desiccant component of the terminal units are shut off when the capacity of the air handling unit is sufficient. In such embodiments, return air may be selectably made to bypass the heat exchanger or desiccant component to reduce pressure losses. In embodiments, the heat exchanger of terminal units 128 or 122 may be replaced with, or combined with, a desiccant enthalpy control device such as a desiccant wheel.

In one or more control embodiments, at times when ventilation load is low such as night-time, the terminal units provide latent and/or sensible load management and the air handling unit is shut down or operated intermittently.

One or more control devices (indicated as "XTL" in the figures) may be provided to control the terminal units, the air handling units or both. In any of the embodiments, the number of air handling units is independent of the number of terminal units.

In any of the embodiments, instead of a desiccant, a condensing heat exchanger may be provided. In any of the terminal unit embodiments, the heat exchanger 406 may be one or more heat exchangers at least one of which may include a condensing coil.

Figure 7:
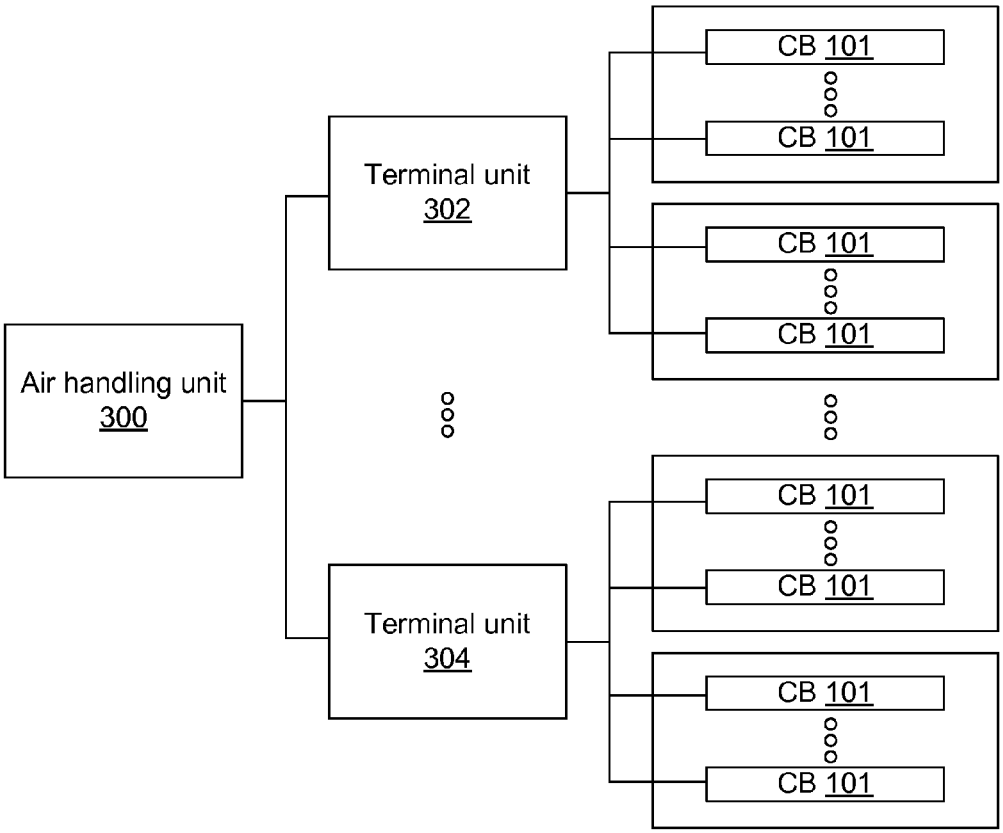
FIG. 7 illustrates a chilled beam system employing local terminal units according to embodiments of the disclosed subject matter.

As illustrated in FIG. 7, the combination of a central air handling unit 300 with any number of multiple terminal units 302, 304 and any number of chilled beam units 101 may be hierarchical in a system such that each terminal unit serves one or more chilled beams and each air handling unit serves one or more terminal unit. In embodiments, the terminal units 302, 304 may be distributed and connected to the same piping as serving the chilled beams. In embodiments, the terminal units 302, 304 are serviced by lower temperature heat transfer fluid (e.g. water) than the chilled beams 101 to permit them to handle part of a latent load, thereby reducing the latent load burdening the air handling unit 300.

In embodiments, the terminal units provide additional capacity without the need to provide additional air through the primary ventilation channels; e.g., FIG. 1 reference numeral 133. In embodiments, the terminal units 122, 128 may have fans or other air moving devices upstream, downstream, or internally to them to permit them to circulate air, as described.

As described above, terminal units may be connected to a main supply air duct that supplies air to one or more chilled beams and is provided from an air handling unit. As indicated, all or part of the air provided to the chilled beams (final primary air) may come from the main supply air duct (initial primary air). The final primary air can be a result of a series or parallel connection between the air handling unit and the terminal unit as described. The terminal unit may recycle room air and provide heating or cooling depending on the mode. Terminal units may provide only one or the other or both. Heating or cooling effect provided by the terminal units may be provided from a heat transfer fluid provided from a boiler or chiller or from an internal unit such as a vapor compression device (e.g. reversible heat pump) or a hydronic device such as an instant on-demand water heater or chiller.

The terminal unit may recycle air from the conditioned space of the chilled beams served by it. Also, as indicated, the return air may be partly (or fully) returned to the air handling unit. In embodiments, the terminal units recycle air through the heat exchanger to provide additional capacity. In this way chilled beams that provide only cooling may be provided with heating capability using heat from the terminal unit. This capability may be added as a retrofit product for an existing chilled beam system that lack heating capability, for example.

Any of the embodiments may be provided with a controller which activates the additional heating or cooling provided by the terminal unit in the event of a load that is greater than the capacity of the chilled beam system. Also, any of the embodiments may be provided with a controller which activates the additional heating or cooling provided by the terminal unit in the event of a detected need or commanded requirement of fast ramp to target conditions. In other words, in the latter case, the additional capacity is used to overcome thermal inertia thereby allowing, lower non-occupancy intervals such as during weekends at an office building or school building. Detection of a condition requiring the additional capacity provided by the terminal unit may be, for example, a current temperature lower than a threshold or a comfort. An open loop program for saving energy may employ regulate temperature using the auxiliary capacity of the terminal unit to maintain a target temperature or enthalpy profile over a period of predicted occupancy/non-occupancy cycle. Thus, the controller may receive the profile as a command or may store standard profiles which are selected via a user interface.

Figure 5A:
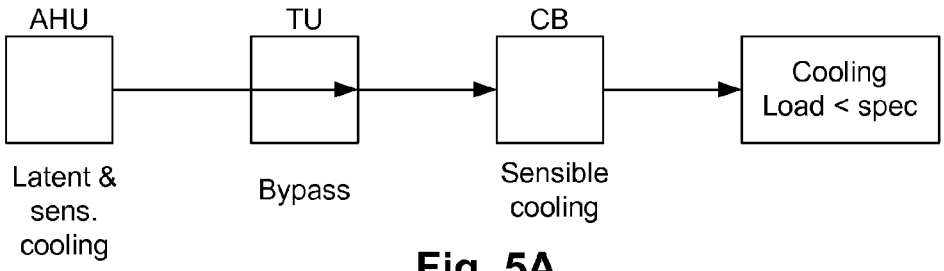
FIGS. 5A through 5G show various mode embodiments of chilled beam system embodiments.

Referring now to FIG. 5A, in a mode embodiment, a cooling load of a conditioned space is less than the capacity of the chilled beam cooling system without the additional capacity provided by the terminal unit. The air handling unit provides 100% of the latent cooling effect and the chilled beams provide sensible cooling effect. Ventilation is provided from the primary supply of air from the air handling unit. The terminal unit is in a bypass mode which may be passive or actively configured by means of a damper as discussed elsewhere herein. In this and other mode embodiments, the terminal unit may provide a ventilation boost or be used to correct flow imbalances in the system.

Figure 5B:
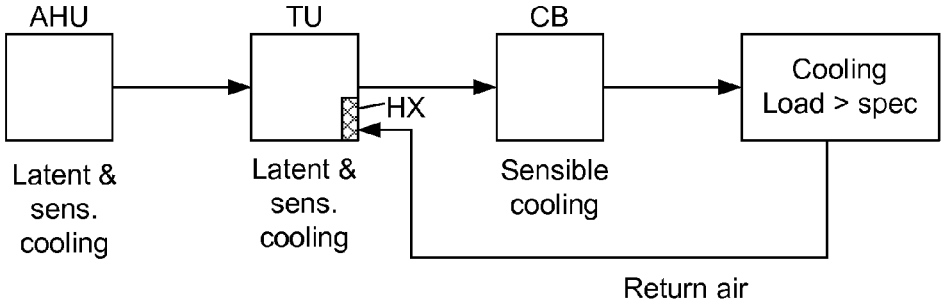

Referring now to FIG. 5B, in a mode embodiment, a cooling load of a conditioned space is greater than the capacity of the chilled beam cooling system without the additional capacity provided by the terminal unit so the terminal adds additional cooling effect to supplement the air handling unit. Alternatively, as discussed above, the present mode embodiment is implemented in response to an open loop control command attending a large thermal inertia and short ramp time before comfortable conditions are to be established. The air handling unit provides part of the latent cooling effect and the chilled beams provide sensible cooling effect, however in this case, the terminal unit provides additional sensible and latent cooling using its heat exchanger. Ventilation is provided from the primary supply of air from the air handling unit. The terminal unit is in a passive or active configuration that provides additional cooling effect to a return air stream, as discussed elsewhere herein.

Figure 5C:
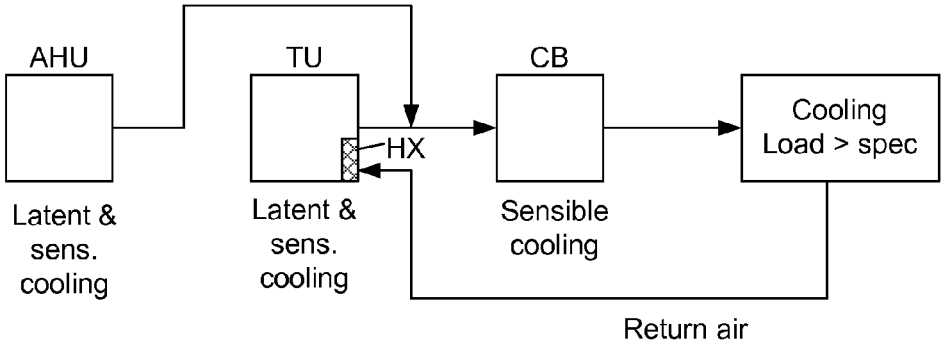

Referring now to FIG. 5C, in a mode embodiment, a cooling load of a conditioned space is greater than the capacity of the chilled beam cooling system without the additional capacity provided by the terminal unit so the terminal heat adds additional cooling effect to supplement the air handling unit. Alternatively, as discussed above, the present mode embodiment is implemented in response to an open loop control command attending a large thermal inertia and short ramp time before comfortable conditions are to be established. The air handling unit provides part of the latent cooling effect and the chilled beams provide sensible cooling effect, however in this case, the terminal unit provides additional sensible and latent cooling using its heat exchanger which is combined in parallel with ventilation air and further cooling effect from the air handler. Ventilation is provided from the primary supply of air from the air handling unit. The terminal unit is in a passive or active configuration that provides the additional cooling effect to a return air stream, as discussed elsewhere herein. The terminal unit may have a fan to permit it to draw return air and inject into a combined supply stream to the chilled beams.

Figure 5D:
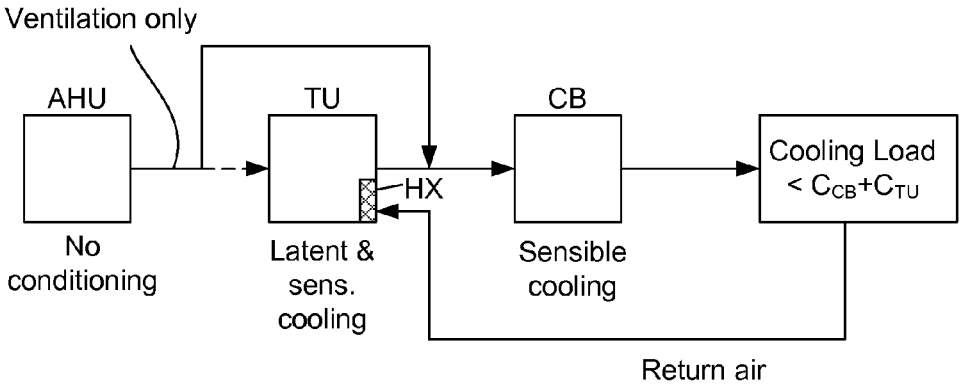

Referring now to FIG. 5D, in a mode embodiment substantially as in FIG. 5C, the air handling unit provides no conditioning and only provides ventilation air. Latent and sensible cooling are provided by the chilled beam and terminal unit or the terminal unit alone. The current mode may be invoked when the cooling load is determined to be lower than the combined capacity of the terminal unit and the chilled beams. Alternatively, in a variation, all of the load is satisfied by the terminal unit.

Figure 5E:
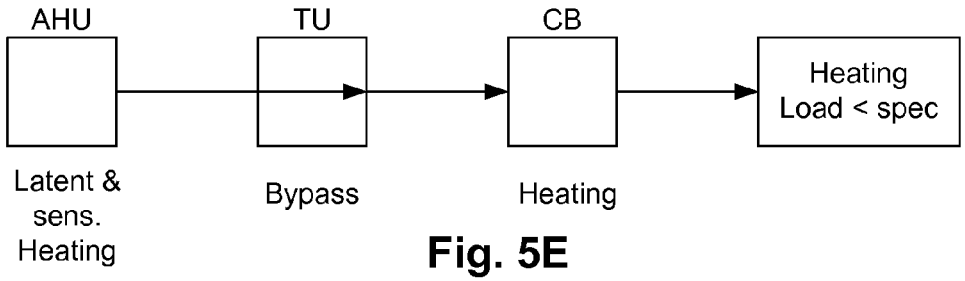

Referring now to FIG. 5E, in a mode embodiment, a heating load of a conditioned space is less than the capacity of the chilled beam heating system without the additional capacity provided by the terminal unit. The air handling unit provides part of the heating effect and the chilled beams provide the remaining heating effect. Ventilation is provided from the primary supply of air from the air handling unit. The terminal unit is in a bypass mode which may be passive or actively configured by means of a damper as discussed elsewhere herein. In this and other mode embodiments, the terminal unit may provide a ventilation boost or be used to correct flow imbalances in the system.

Figure 5F:
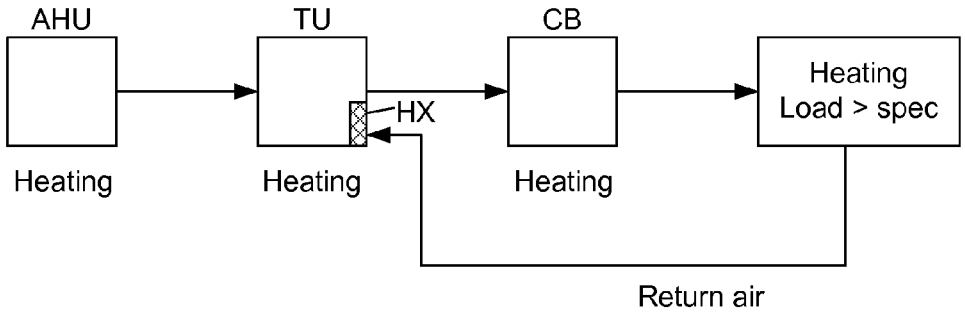

Referring now to FIG. 5F, in a mode embodiment, a heating load of a conditioned space is greater than the capacity of the chilled beam heating system without the additional capacity provided by the terminal unit so the terminal unit adds additional heating effect to supplement the air handling unit. Alternatively, as discussed above, the present mode embodiment is implemented in response to an open loop control command attending a large thermal inertia and short ramp time before comfortable conditions are to be established. The air handling unit provides part of the latent heating effect and the chilled beams provide heating effect, however in this case, the terminal unit provides additional and latent heating using its heat exchanger. Ventilation is provided from the primary supply of air from the air handling unit. The terminal unit is in a passive or active configuration that provides additional heating effect to a return air stream, as discussed elsewhere herein.

Figure 5G:
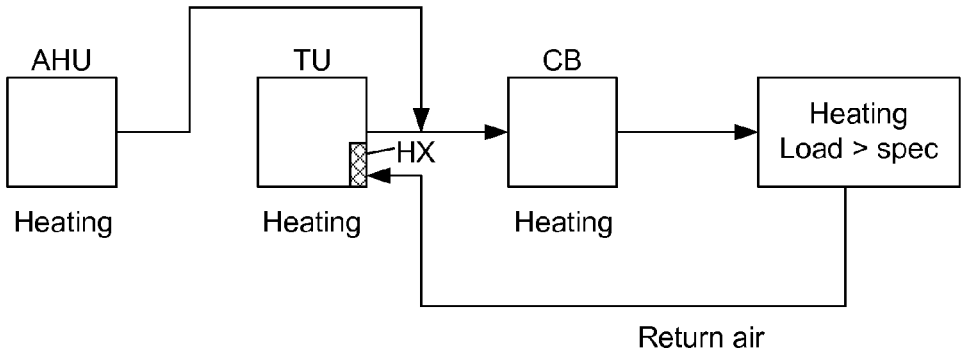

Referring now to FIG. 5G, in a mode embodiment, a heating load of a conditioned space is greater than the capacity of the chilled beam heating system without the additional capacity provided by the terminal unit so the terminal heat adds additional heating effect to supplement the air handling unit. Alternatively, as discussed above, the present mode embodiment is implemented in response to an open loop control command attending a large thermal inertia and short ramp time before comfortable conditions are to be established. The air handling unit provides part of the latent heating effect and the chilled beams provide heating effect, however in this case, the terminal unit provides additional and latent heating using its heat exchanger which is combined in parallel with ventilation air and further heating effect from the air handler. Ventilation is provided from the primary supply of air from the air handling unit. The terminal unit is in a passive or active configuration that provides the additional heating effect to a return air stream, as discussed elsewhere herein. The terminal unit may have a fan to permit it to draw return air and inject into a combined supply stream to the chilled beams.

Figure 5H:
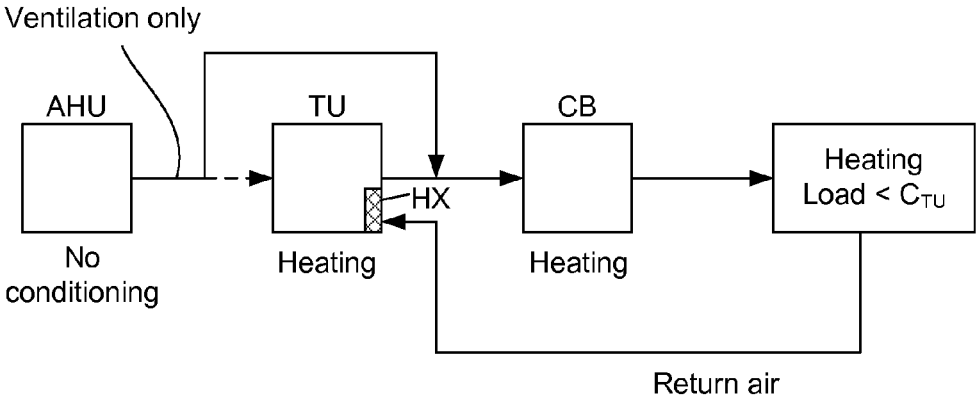

Referring now to FIG. 5H, in a mode embodiment substantially as in FIG. 5C, the air handling unit provides no conditioning and only provides ventilation air. Latent and heating are provided by the chilled beam and terminal unit or the terminal unit alone. The current mode may be invoked when the heating load is determined to be lower than the combined capacity of the terminal unit and the chilled beams. Alternatively, in a variation, all of the load is satisfied by the terminal unit.

Figure 6A:
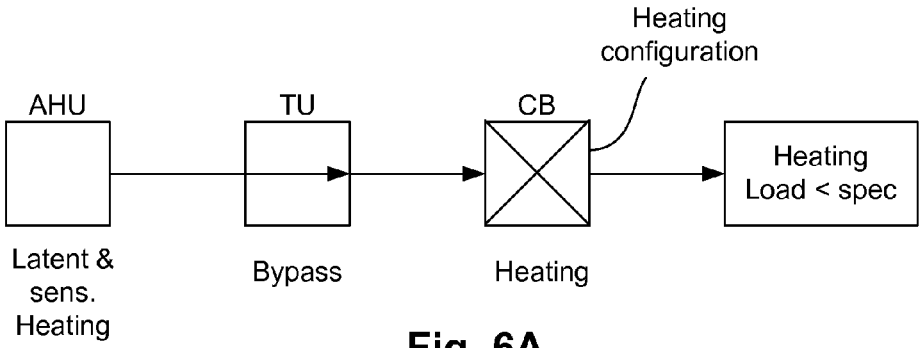
FIGS. 6A and 6B show mode embodiments chilled beam system embodiments in which a chilled beam or a terminal unit is configurable for heating mode.
Figure 6B:
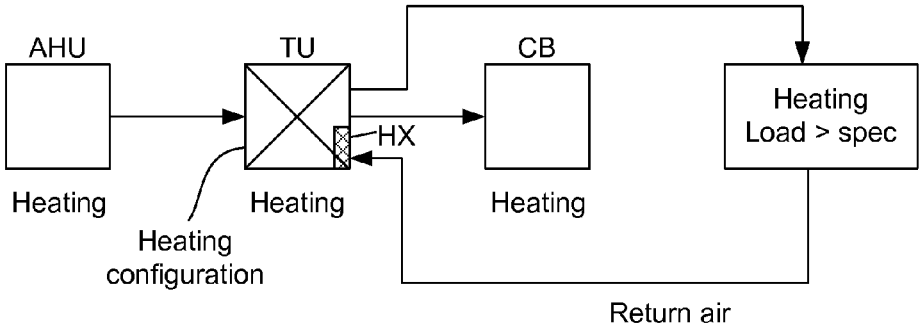

Referring now to FIG. 6A, a mode embodiment as in any of the embodiments of FIGS. 5E through 5H, a chilled beam is configured in a heating mode that facilitates heating. Configurable chilled beam embodiments are described below. Referring to FIG. 6B, a mode embodiment as in any of the embodiments of FIGS. 5E through 5H, a terminal unit is configured in a heating mode that facilitates heating. Configurable terminal unit embodiments are described below.

Figure 12A:
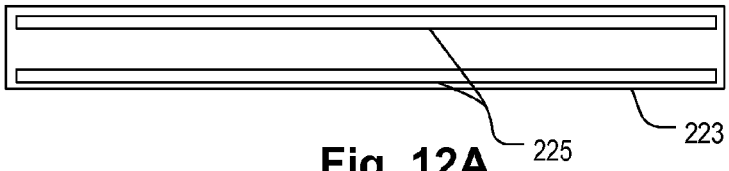
FIGS. 12A and 12B illustrate respective configurations of a configurable chilled beam from the perspective of an observer looking up at installed chilled beam.
Figure 12B:
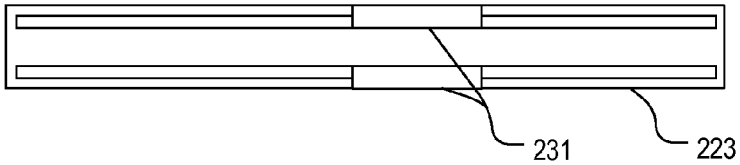
Figure 9A:
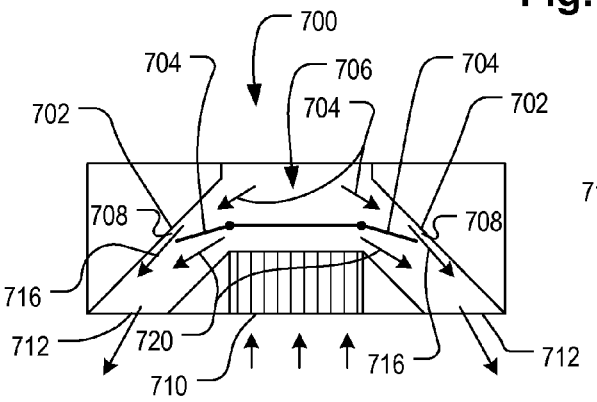
FIGS. 9A through 9C show embodiments of chilled beam units that can be configured for heating for the purpose of promoting mixing during a heating mode.
Figure 9B:
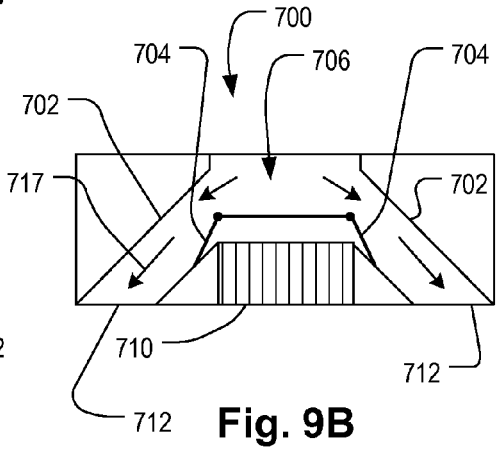
Figure 9C:
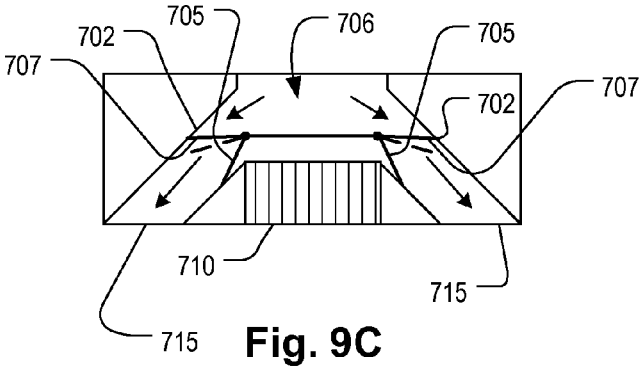

Referring now to FIG. 9A, a configurable chilled beam 700 has a primary air plenum 706 with slit discharge 708 formed by components 702 of a housing thereof and the blade 704 of a damper. The primary air 704 flows through the slit 704 to form a jet 716 which induces air 720 through a heat exchanger 710. The blade 704 may be fluted to form low aspect ratio jets and provide standoffs to provide precise gaps 708 that are regularly spaced along the chilled beam 700 longitudinal axis. The mixed conditioned air stream leaves the chilled beam 700 through a downward opening channel 712. As shown in FIG. 9B, in a heating mode, the damper blade 704 moves to an opposite wall of the channel 712 blocking flow through the heat exchanger and providing a less restricted channel 712 for the air flow, the nozzles 708 being effectively eliminated. FIG. 9C shows a variation of the embodiment of FIGS. 9A and 9B in which the baffle blades 705 span a smaller fraction of the longitudinal length of the beam so that air from the plenum 706 leaves through low aspect ratio registers or openings 715. Damper blades 707 may also be provided at other portions of the chilled beam length to close off the plenum 706 exits except at the parts opened by blades 705. Alternatively, a fixed nozzle configuration of FIG. 9A may remain except at the portions opened by the damper blades 705. FIGS. 12A and 12B illustrate the respective configurations of a configurable chilled beam from the perspective of an observer looking up at installed chilled beam. The cooling configuration is shown in FIG. 12A. The chilled beam 223 has normally configured slot openings 225. In FIG. 12B, a portion of the slots have switched to low aspect ratio openings 231 through which primary air may be ejected at a high volume. The remainder of the slot openings 225 may be closed or remain open in a restricted fashion or may be closed as described with respect to the embodiments of FIG. 9C.

Figure 8A:
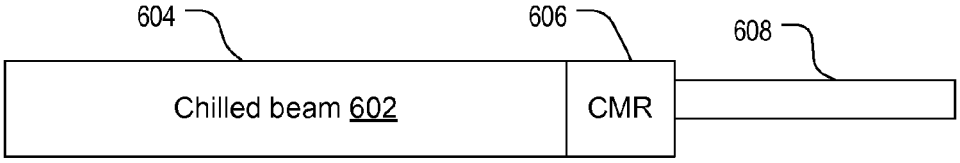
FIGS. 8A and 8B show chilled beams with alternative additional selectable mixing register for heating mode utilization.

Referring to FIG. 8A, a configurable register box 606 may be attached to the end of a chilled beam 604 to permit air to be selectively discharged from the box in a low aspect of diffuse jet. The register box 606 may be provided with a standard mixing diffuser which is oriented to throw heated air toward the area of the occupied space generally covered by the chilled beam 602. Flow may be diverted by a damper in the register box 606 to divert all, or a selected fraction, of the primary toward the mixing register outlet which may be located on a side or the bottom of the register box. In an alternative configuration, a register box 607 is provided at a terminal end of the primary air plenum internal to the chilled beam. The register box 607 may be opened during heating mode to vent additional air from the primary air plenum. A fan in the terminal unit may cooperatively boost the flow of primary air to maintain flow through the chilled beam coil whilst conveying additional air through the register box. The latter function may be invoked by a controller to satisfy a greater ventilation requirement as well, for example, in response to a command by a room-use scheduler.

Figure 10A:
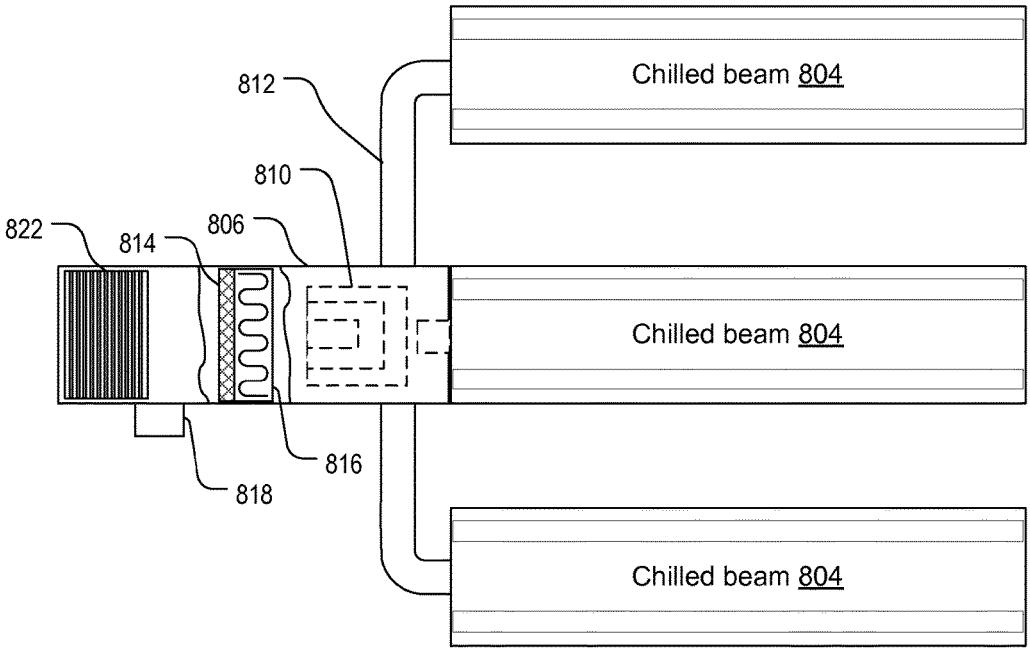
FIGS. 10A and 10B shows embodiments of terminal units that can be configured for heating for the purpose of promoting mixing during a heating mode.
Figure 10B:
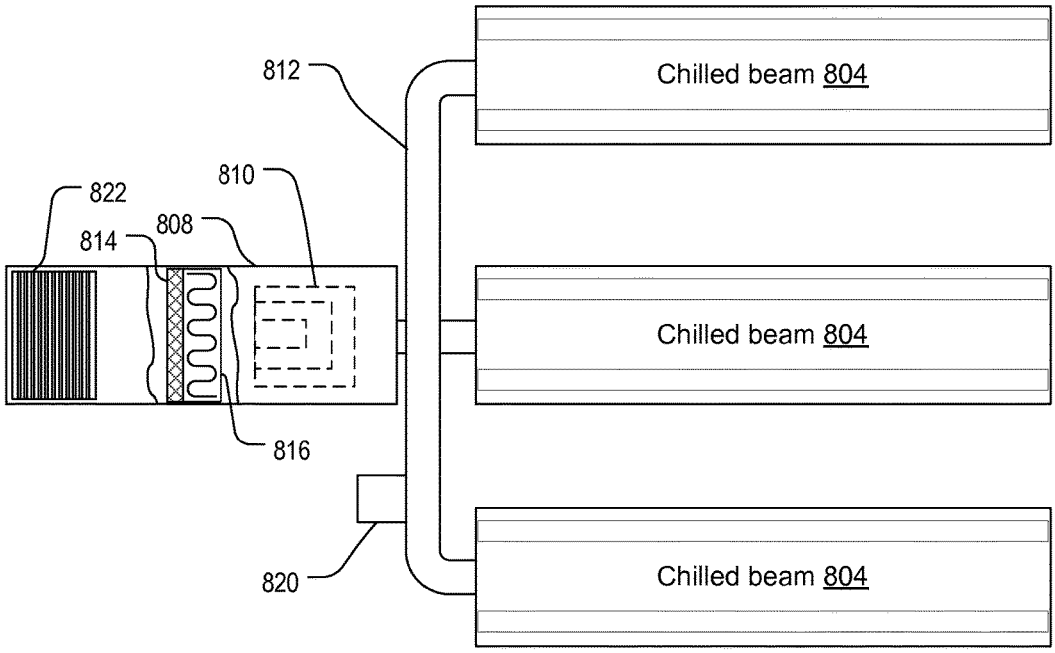

As shown in FIG. 10A, in an embodiment, a mixing register box is provided as part of a terminal unit serving multiple chilled beams 804. In the example shown, the terminal unit 806 has a return register 822 which is used to take up return air from the occupied space. A heat exchanger 816 and filter 814 are provided as in the embodiments of FIGS. 3 and 4. Air from the air handler, including fresh air, is provided directly to the terminal unit 806 via a connection 818. Ducting 812 distributes air from the terminal unit 806. In a variation 808 of the foregoing, air from the air handler is directly applied to the ducting 812 per the parallel configuration of FIG. 3. In both embodiments, a mixing register 810 is selectively available for heating either in combination with the discharges of the chilled beam or separately using a control damper. The mixing registers 810 may be bypassed during cooling using a suitable control damper (not shown). The terminal unit 806, 808 may serve multiple or single chilled beams. In embodiments, the terminal units incorporate low profile components, such as, optionally fans and the other components described such as to form a low profile unitary device that can be mounted above a hung ceiling.

In any of the embodiments, the controller may provide the additional capacity of the terminal unit responsively to a change in detected or predicted occupancy. For example, this may be a relevant strategy for occasional high occupancy or high activity levels that would generate moisture during cooling mode operation.

Embodiments of this invention are described herein, include the best mode known to the inventors for carrying out the claims. Variations of the disclosed embodiments may become apparent to those of ordinary skill in the art in light of the present disclosure. The inventors expect that the invention will be practiced using details and variations that are left or our that depart the descriptions herein. Thus, the invention includes modifications, variations, and equivalents of the subject matter recited in the claims appended hereto.

In the present application, the term "terminal unit" is used to describe a particular component of a chilled beam system even though chilled beam units may be identified as "terminal units" by those skilled in the art. In the present application, the term "chilled beam" is used to identify a chilled beam type of terminal unit that includes a heat exchanger and induces flow through the heat exchanger by means of primary air jets.

Figure 11:
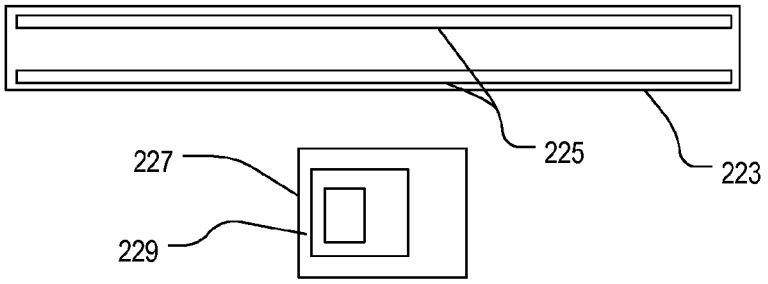
FIG. 11 illustrates the terminology of a low aspect ratio flow or jet and a high aspect ratio flow or jet.

Referring to FIG. 11, the terms low aspect ratio jet or flow and high aspect ratio flow or jet are used herein to characterize the difference between the jets of chilled beams and typical heating registers. For example the high aspect ratio jet such as produced by a chilled beam 223 (a high aspect ratio jet) is typically formed by a linear slot opening 225. The low aspect ratio discharge, or flow or jet produced by a mixing register 227 is discharged by a low aspect ratio opening 229 (or series thereof). The views in FIG. 11 are from the bottom.

The term mixing register is generally used to identify a diffuser or opening with an aspect ratio that is lower than about five. In all embodiments where the use of a mixing register is invoked, by configuration of the chilled beam or the terminal unit, the volume of primary air (including air from the terminal unit) may be increased, for example, when a heating mode signal is generated.

Figure 8B:
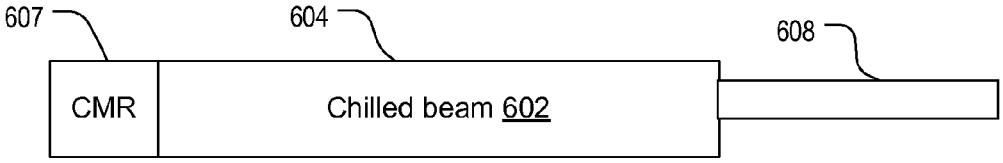
Figure 13A:
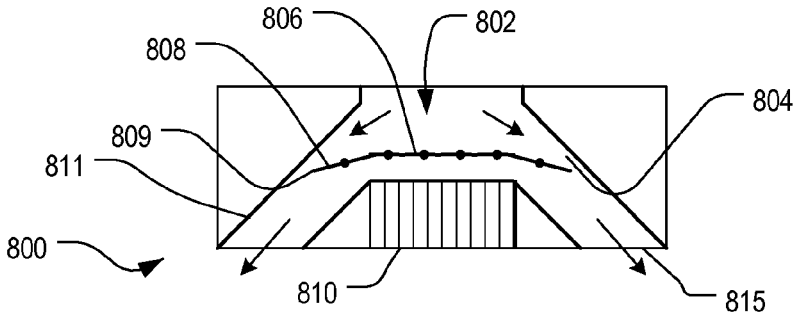
FIGS. 13A and 13B show cooling and heating modes of another configurable chilled beam embodiment.
Figure 13B:
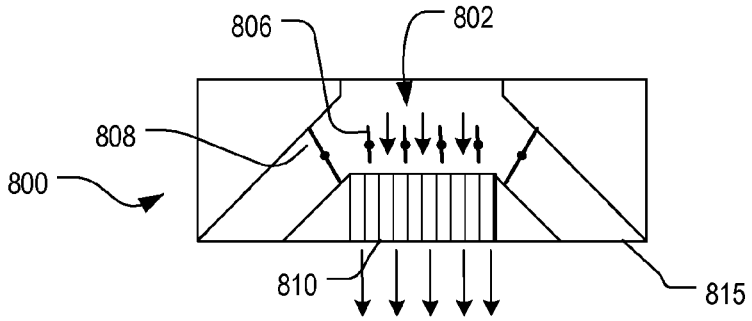
Figure 14A:
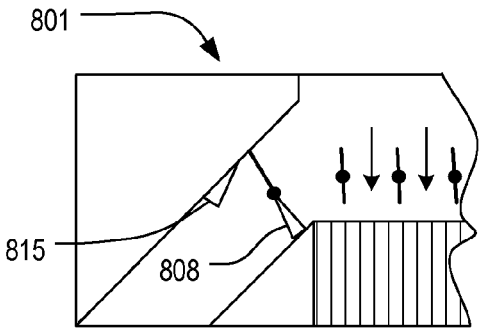
Figure 14B:
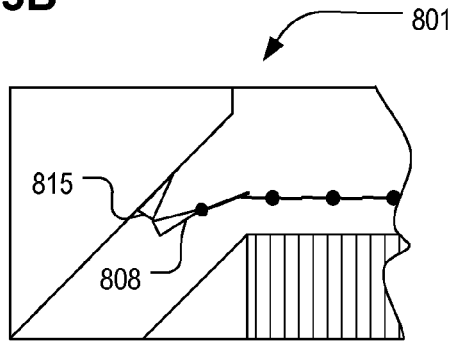
Figure 14C:
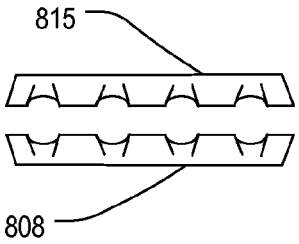
Figure 14D:
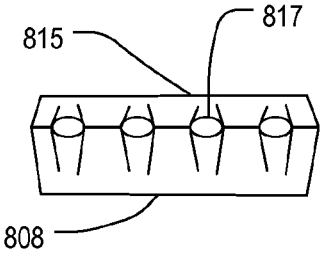

FIGS. 13A and 13B show cooling and heating modes of another configurable chilled beam embodiment in which primary air is discharged from a plenum 802 through a heat exchanger 810 when the chilled beam 800 is placed in heating mode. The heating mode is shown in FIG. 8B. The normal chilled beam configuration is shown in FIG. 13A. Dampers 806 and 808 close to form channels 804 forming jets that induce a flow of air through the heat exchanger 810 in the normal chilled beam operating mode. The edge 809 of the damper blade 808, as stated elsewhere, can be fluted to define channels. Also the an opposing element can cooperate with the fluted blade to form a series of orifices to create a series of jets along the chilled beam. FIGS. 14A and 14B show the a portion of an end cutaway of a chilled beam 801. FIG. 14A shows the heating configuration and FIG. 14B shows the cooling configuration. The chilled beam 801 has a fluted damper blade 808 which cooperates with a fixed blade 815 whose shape is a mirror image of the fluted damper blade 808. As shown in FIGS. 14C and 14D, the mirror image flutes of the blades 808 and 815 engage to form jet openings 817 that are regularly spaced apart when the damper blade 808 is tilted to the cooling position. The cooling position is shown in FIG. 14D and a transitional position between heating and cooling shown in FIG. 14C.

The terms "a" and "an" and "the" and similar terms are to be construed to cover both the singular and the plural, unless otherwise indicated herein or clear from the context of usage. The terms "comprising," "having," "including," and "containing" are open-ended terms that do not preclude additional elements or features unless otherwise indicated. The terms "attached" and "connected" mean partly or wholly contained within, affixed to, integral to, or joined together. Ranges of values include each separate value within the range, unless otherwise indicated and each separate value in the range is indicated by recitation of a range as if separately disclosed. Unless otherwise indicated or clear, methods described herein may be performed in any sequential order. Examples described herein are not intended to introduce limitations to the inventions.

What is claimed is:

1. A method of satisfying a load of a conditioned space using a chilled beam system, the method comprising:

providing a plurality of chilled beam units, each having at least one first heat exchanger and configured to receive primary air at a primary air inlet, eject the primary air through at least one jet to induce a flow of secondary air through the at least one first heat exchanger, the first heat exchanger being configured to receive a liquid heat transfer fluid from a heating or cooling source;

providing a terminal unit configured to convey primary air from a central air handling unit to the primary air inlet of at least one of the chilled beam units, wherein the terminal unit has a second heat exchanger and is configured to convey conditioned return air to the primary air inlet of the at least one chilled beam unit;

drawing conditioned air from a space conditioned by the chilled beam units into the terminal unit as a return air stream;

cooling the return air stream extracted from the conditioned space in the terminal unit with the second heat exchanger;

mixing the cooled return air with the primary air from the central air handling unit; and conveying the mixture of the cooled return air and the primary air to the primary air inlet of the at least one of the chilled beam units.

2. The method of claim 1, wherein the conveying primary air from a central air handling unit includes conveying primary air at a quality and rate that is sufficient to satisfy a ventilation load of the conditioned space but insufficient to supply a design thermal load requirement.

3. The method according to claim 1, further comprising:

driving a fan in the terminal unit, wherein said conveying the mixture of the cooled return air and the primary air includes blowing the mixture with the fan.

4. The method according to claim 1, wherein the drawing the conditioned air into the terminal unit takes place without a venturi effect.

5. A chilled beam system for a conditioned space, comprising:

a plurality of chilled beam units, each having at least one first heat exchanger and configured to receive primary air at a primary air inlet and to eject the primary air through at least one jet to induce a flow of secondary air through the at least one first heat exchanger, the first heat exchanger being configured to receive a liquid heat transfer fluid from a heating or cooling source;

a plurality of terminal units, each terminal unit configured to convey the primary air from a central air handling unit to the primary air inlet of at least one of the chilled beam units, wherein each terminal unit has a second heat exchanger, and each terminal unit is configured to condition a return air stream extracted from the conditioned space using the second heat exchanger, mix the conditioned return air with the primary air from the central air handling unit to produce a combined primary air stream, and convey the combined primary air stream to the primary air inlet of the at least one of the plurality of chilled beam units.

6. The system of claim 5, wherein the primary air from the central air handling unit is at a quality and rate that is sufficient to satisfy a ventilation load of the conditioned space but insufficient to supply a design thermal load requirement.

7. The system of claim 5, wherein each terminal unit includes a condensing cooling coil configured to reduce the moisture content of the return air.

8. The system of claim 5, wherein each terminal unit includes a desiccant component configured to reduce the moisture content of the return air.

9. The system of claim 5, wherein the central air handling unit serves multiple terminal units, each of the terminal units serving multiple chilled beam units.

10. The system of claim 9, wherein the terminal units are distributed through one or more structures to place them close to the chilled beam units served by each.

11. The chilled beam system according to claim 5, wherein each terminal unit includes a blower that forces air out of the terminal unit and into the primary air inlet of at least one of the plurality of chilled beam units.

12. The chilled beam system according to claim 5, wherein each terminal unit draws in the return air without a venturi nozzle.

* * * * *